US009121191B2

(12) United States Patent
Kellogg

(10) Patent No.: US 9,121,191 B2
(45) Date of Patent: Sep. 1, 2015

(54) POOL CLEANERS

(71) Applicant: Pool Systems Pty Ltd, Brendale, Queensland (AU)

(72) Inventor: James Edward Kellogg, Southport (AU)

(73) Assignee: Pool Systems Pty Ltd., Brendale, Queensland (AU)

( * ) Notice: Subject to any disclaimer, the term of this patent is extended or adjusted under 35 U.S.C. 154(b) by 3 days.

(21) Appl. No.: 14/188,097

(22) Filed: Feb. 24, 2014

(65) Prior Publication Data

US 2014/0284258 A1 Sep. 25, 2014

Related U.S. Application Data

(63) Continuation-in-part of application No. 12/581,272, filed on Oct. 19, 2009, now abandoned.

(51) Int. Cl.
*E04H 4/16* (2006.01)

(52) U.S. Cl.
CPC ..... *E04H 4/1663* (2013.01); *E04H 4/1654* (2013.01); *E04H 4/16* (2013.01)

(58) Field of Classification Search
CPC ..... E04H 4/16; E04H 4/1654; E04H 4/1663; E04H 4/1681
USPC ..... 15/1.7; 210/167.16, 167.17
See application file for complete search history.

(56) References Cited

U.S. PATENT DOCUMENTS 4,023,227 A 5/1977 Chauvler
4,098,266 A 7/1978 Muchisky
4,208,752 A 6/1980 Hofmann
4,262,941 A 4/1981 Lalikos et al.
4,351,077 A 9/1982 Hofmann
(Continued)

FOREIGN PATENT DOCUMENTS

AU 521920 12/1978
AU 539276 8/1979
(Continued)

*Primary Examiner* — Robyn Doan
*Assistant Examiner* — Tatiana Nobrega
(74) *Attorney, Agent, or Firm* — Fitzpatrick, Cella, Harper & Scinto

(57) ABSTRACT

A pool cleaner has a float and close proximity counter weight that together improve the applied torque to steer the pool cleaner, a body 13 has slots 33 diametrically opposed on the body 13 and these receive tangs 66 and 67 which depend from a circular body 68. The body 68 carries a circular guide-way 69 with a guide 70 travelling between opposite ends of the guide-way. A float 26 is connected to the guide by two pivot arms 71 and 72 which have openings at their ends so that they slide into position and are retained in place by snap in retainers 73 and 74. The guide 70 has a circular shoulder 75 and at opposite ends of the guide has projections 76 and 77 such that the rail 78 of the guide-way is retained between the surface 75 and the inner surfaces 78 and 79 of the projections 76 and 77 with the rail against the surface 80. A corresponding structure is on the opposite side of the guide and this retains the rail 81 so that the guide slides around a circular path defined by the rails 78 and 81. The guide 70 includes internal bores 82 and 83 at opposite ends and these are blind bores with an internal rib 84 so that stubs projecting from retainers 73 and 74 may snap fit into the bores 82 and 83 to retain the arms 71 and 72 in place and permit the pivoting action of the float 26 as illustrated in FIG. 8 and FIG. 9.

14 Claims, 8 Drawing Sheets

(56) References Cited

U.S. PATENT DOCUMENTS

| | | | | |
|---|---|---|---|---|
| 4,463,468 | A | 8/1984 | Chauvier | |
| 4,642,833 | A | 2/1987 | Stoltz et al. | |
| 4,742,593 | A | 5/1988 | Kallenbach | |
| 4,761,848 | A | 8/1988 | Hofmann | |
| 4,807,318 | A | 2/1989 | Kallenbach | |
| 5,002,316 | A | 3/1991 | Chohan | |
| 5,033,504 | A | 7/1991 | Kallenbach | |
| D325,796 | S | 4/1992 | Kallenbach | |
| 5,105,848 | A | 4/1992 | Kallenbach | |
| 5,226,205 | A * | 7/1993 | Pearce | 15/1.7 |
| 5,315,728 | A | 5/1994 | Atkins | |
| 5,398,362 | A * | 3/1995 | Chauvier | 15/1.7 |
| 5,418,995 | A | 5/1995 | Rice et al. | |
| 5,421,054 | A | 6/1995 | Dawson et al. | |
| 5,450,645 | A | 9/1995 | Atkins | |
| 5,465,443 | A | 11/1995 | Rice et al. | |
| 5,617,606 | A | 4/1997 | Scott | |
| 5,655,246 | A | 8/1997 | Chang | |
| D417,905 | S | 12/1999 | Kallenbach | |
| 6,119,293 | A * | 9/2000 | Phillipson et al. | 15/1.7 |
| 6,122,794 | A | 9/2000 | Atkins | |
| 6,311,353 | B1 * | 11/2001 | Phillipson et al. | 15/1.7 |
| 6,751,822 | B2 * | 6/2004 | Phillipson et al. | 15/1.7 |
| 6,966,092 | B2 * | 11/2005 | Sebor | 15/1.7 |
| 7,060,182 | B2 | 6/2006 | Erlich et al. | |
| 7,159,263 | B2 * | 1/2007 | Sebor | 15/1.7 |
| 7,401,372 | B2 | 7/2008 | Sebor | |
| 7,434,285 | B1 | 10/2008 | Chang | |
| D605,370 | S * | 12/2009 | Kellogg | D32/21 |
| 2005/0097687 | A1 * | 5/2005 | Phillipson et al. | 15/1.7 |
| 2006/0254005 | A1 * | 11/2006 | Phillipson et al. | 15/1.7 |
| 2007/0256257 | A1 * | 11/2007 | Phillipson et al. | 15/1.7 |
| 2008/0141471 | A1 | 6/2008 | Supra | |
| 2008/0276388 | A1 * | 11/2008 | Dodd | 15/1.7 |
| 2010/0139017 | A1 | 6/2010 | Stoltz | |
| 2011/0024339 | A1 * | 2/2011 | Brown | 210/167.1 |

FOREIGN PATENT DOCUMENTS

| | | | |
|---|---|---|---|
| AU | 539357 | | 2/1981 |
| AU | 577825 | | 1/1985 |
| AU | 576806 | | 7/1985 |
| AU | 593302 | | 6/1986 |
| AU | 583358 | | 9/1986 |
| AU | 589683 | | 9/1986 |
| AU | 584526 | | 10/1987 |
| AU | 608895 | | 12/1989 |
| AU | 613227 | | 2/1990 |
| AU | 611826 | | 3/1990 |
| AU | 607589 | | 8/1990 |
| AU | 634742 | | 8/1990 |
| AU | 645746 | | 10/1990 |
| AU | 637934 | | 3/1992 |
| AU | 654229 | | 8/1993 |
| AU | 675066 | | 11/1993 |
| AU | 660816 | | 1/1994 |
| AU | 665686 | | 2/1994 |
| AU | 668636 | | 9/1994 |
| AU | 678214 | | 9/1994 |
| AU | 659580 | | 1/1995 |
| AU | 685236 | | 8/1995 |
| AU | 728551 | | 4/1996 |
| AU | 691053 | | 5/1996 |
| AU | 693934 | | 5/1996 |
| AU | 694284 | | 5/1996 |
| AU | 701368 | | 1/1997 |
| AU | 704603 | | 1/1997 |
| AU | 714168 | | 9/1997 |
| AU | 696842 | | 7/1998 |
| AU | 702602 | | 7/1998 |
| AU | 740226 | | 5/1999 |
| AU | 748873 | | 12/1999 |
| AU | 2002222327 | B2 | 6/2002 |
| AU | 2002222327 | C1 | 6/2002 |
| AU | 2002256099 | | 10/2002 |
| AU | 2004258083 | | 1/2003 |
| AU | 2005279959 | | 3/2006 |
| AU | 2005285018 | | 3/2006 |
| GB | 2322539 | A | 9/1998 |
| WO | 2004/007872 | | 1/2004 |
| WO | 2006/109118 | | 10/2006 |
| WO | WO 2006109118 | A1 * | 10/2006 |
| WO | 2008037024 | | 4/2008 |

* cited by examiner

POOL CLEANERS

FIELD OF THE INVENTION

This invention relates to pool cleaners of the self-propelled type.

BACKGROUND OF THE INVENTION

Automatic self-propelled suction pool cleaners are well known to pool owners. These pool cleaners operate essentially as an underwater vacuum cleaner that sucks up water and debris through a lower suction inlet end. An upper hose ends is attached to a suction hose connected to a skimmer box inlet. Debris sucked up by the cleaner is collected in the skimmer box filter. A flexible skirt or disk surrounds the lower suction inlet end at an angle to the cleaner body. The skirt regulates the suction to keep the cleaner pressed against the pool surface but still allows the cleaner to travel across the surface. The skirt also scrapes and dislodges debris from a pool floor or wall.

Self-propelled cleaners travel across a pool floor in a random manner following the suction hose around the pool. The suction hose floats on the water surface and itself moves in response to water flow. For this reason, it is common practice to install flow diverters into the return water outlets from the filter.

In the art, the side of the cleaner that faces upwards is generally considered the front of the cleaner and the side that faces downwards is considered the back of the cleaner. Following this convention, the cleaner travels backwards around the pool with the leading side being the back of the cleaner and the trailing side at the front. This accepted terminology in relation to the front and back of a self-propelled cleaner will be followed in the present specification and claims.

The general principles upon which self-propelled pool cleaners self-propel is by the use of a pulsating flow of water. A valve intermittently opens and closes so as to provide the water pulse. There are two types of valve arrangements used in the commercially available cleaners. One has a flexible diaphragm and another has a hammer valve. It will be appreciated that the present invention is independent upon the manner in which the water pulse is generated and no limitation is intended thereby.

It is usual for self-propelled pool cleaners to have the ability to climb pool walls and other obstacles. Early cleaners tended to travel along a pool wall until they broke the surface of the water. This would cause a break in suction and the pool cleaner would free fall to the pool floor. A break in suction may also occur if the skirt passes over a projection such as a pool light or other obstacle. A disadvantage with the cleaner free falling from a wall is that the cleaner may not fall with the skirt downwards so that it can continue to clean and remains stuck on the pool floor.

In order to address this problem, some cleaners have a fixed float at the front and a counter weight at the back so when the cleaner free falls towards the bottom, the float serves to right the cleaner so that it lands 'cat like' with the skirt facing downwards and engaging the bottom of the pool.

An example of a cleaner having a weight at the back and a float at the front is described in WO2004/007872. In this cleaner the float is at the end of a fixed arm extending from the body at a position that is closer to the skirt than the weight which extends from about midway along the cleaner body.

U.S. Pat. No. 6,119,293 describes a cleaner that has an arrangement that is similar to that in WO2004/007872 with respect to the relative positions of the weight and float with respect to the body. That is, the float is attached to the body at the front at the base body adjacent to the skirt and lower on the body than the weight. One difference compared to WO2004/007872 is that the float is not fixed with reference to the body. U.S. Pat. No. 6,119,293 describes three different ways in which the position of the float relative to the body may vary. The first is placing a ball float on a flexible stem, such that the float can move in any direction; the second is placing the float on a rigid arm mounted to a pivot point for movement in a backwards and forward direction only and the third is a ball float mounted on an arm mounted on a ball joint within a D shaped cut out. This cut out allows the rotational movement in the three degrees of rotational movement.

WO2006/109118 describes a pool cleaner with float suspended on a pair of slotted arms which move freely in bilateral pins. In contrast to the cleaners of WO2004/007872 and U.S. Pat. No. 6,119,293, the weight is located towards the bottom of the body towards the skirt and the float is located much higher on the body, above the centre of mass of the body. The slots are much larger than the pins so the float arms not only move in and out but there is enough play between the slots and the pins that the float has limited sideways movement.

In FIG. 3 of that specification, the position of the float arms are illustrated for the situation where the cleaner is travelling along a wall. Specifically since the pivot pins are fixed on the sides of the cleaners the upper arm nearest the wall shortens relative to the pin and the lower arm furthest from the wall lengthens relative to the pin effectively jamming the float in an inclined attitude with two pins of contact for each arm, one with the pin and the other with the body of the cleaner. In the description this position is said to aid the cleaner in climbing the wall. No mention or suggestion is made of the float serving any other purpose.

Another self-propelled pool cleaner is known commercially as the "Kreepy Krawley". This cleaner has a pair of floats pivotally connected by pivot arms about a pivot axis transverse to the longitudinal axis of the body. This arrangement is commonly referred to in the art as a "dive float assembly". When traversing a horizontal pool floor, the pivot arms are vertical such that the floats are suspended directly above the front of the body. However, as the cleaner begins to climb the wall the floats pivot towards the hose and lie against and parallel to the body. As the cleaner travels further towards the water surface, the orientation of the body changes until it reaches an angle where the floats pivot backwards away from the hose end towards the skirt end. This causes a change in the centre of mass, thereby causing the cleaner to turn down the wall.

WO 2008/037024 describes yet another cleaner having a float pivotally mounted to a pool cleaner body. The float is cylindrical and is suspended by two pivot arms that allow the float only to pivot about an axis transverse to the longitudinal axis of the body. The pivot axis of the float is directly over the weight, the aim of this arrangement is to stabilise the body as it sinks to the bottom so as to keep it upright.

Each of the pool cleaners discussed above can clean a pool floor and wall. While it is desirable to clean the pool wall, most sediment accumulates on the pool bottom so that the length of time that a cleaner is travelling on the pool wall means that there is less time spent cleaning the pool bottom. Thus it is an object of the present invention to provide a pool cleaner that has a greater residence time on the bottom of the pool. This object is achieved by providing a cleaner that can turn back down a pool wall at a sharper angle than known cleaners.

SUMMARY

In one aspect there is provided a self-propelled pool cleaner comprising:

an inclined body having a longitudinal axis, a lower suction end, an upper outlet end connectable to a suction hose, an upper side and a lower side, the body being forwardly inclined relative to the direction of travel across a submerged surface;

a counter weight mounted to the lower side of the body;

a float assembly including a float suspended from the upper side of the body and at least one rigid pivot arm having a distal end attached to the float;

a float mounting mechanism including a pivot pin extending transversely from the body to which the proximal end of the at least one rigid pivot arm is pivotally mounted to allow pivotal movement of the float towards and away from the lower suction end of the body;

a guideway defining a circular arc having an axis that is co-axial with the longitudinal axis of the body that is located on the upper side of the body at a position that is vertically opposite to at least a part of the counter weight when the cleaner is traversing a horizontal surface;

the pivot pin of the float mounting mechanism is mounted to the guideway for movement within the guideway to allow side to side movement of the attached float that is constrained to movement through an arc co-axial with the longitudinal axis of the body;

wherein the pivotal movement of the float towards and away from the lower end of the body and the side to side pivotal movement are independent such that the only rotational degrees of freedom in which the float is permitted to move are forwards and backwards and side to side.

The mounting mechanism limits the rotational movement of the float to two degrees of freedom i.e. side to side movement and forwards and backwards movement. As the float is constrained to these two movements, right to left movement is not permitted.

None of the prior art pool cleaners mentioned above have such a limitation of movement to the two degrees of rotational freedom. Such a novel restriction of movement in combination with a counter weight opposite the guideway assists in turning the cleaner back down a pool wall as will be discussed below.

It will be appreciated that the orientation of the float with respect to the cleaner body will depend upon the attitude or orientation of the cleaner body. When traversing a horizontal surface, the float would normally be oriented such that the pivot arm(s) extend vertically above the body. When the cleaner begins to climb a vertical surface such as a pool wall, the float can pivot and/or move sideways in response to the non-horizontal movement of the cleaner body.

When pool cleaners, of either the invention or the prior art, meet a junction between the pool floor and the wall, they begin to climb the wall in the direction of the hose. The orientation of the cleaner is tilted slightly due to the weight of the hose such that the cleaners initially travel up the wall at an angle of between about 30° and about 50° to the vertical.

As the cleaner of the invention traverses the wall at such an angle, the float moves sideways with respect to the body towards its zenith (or towards the surface of the water) until it meets the limit of the side to side movement. As the float reaches the limit of side to side movement, the float applies an upwards moment or rotational force in the same direction as the counter weight is applying a downward moment or rotational force. Because the movement of the float is limited to side to side movement, right to left movement not being permitted, the torque applied by the side to side movement of the float to turn the body is optimized. As will be discussed in more detail below with reference to the drawings, this allows the pool cleaner of the invention to turn sooner or more sharply back down a pool wall than prior art cleaners.

The effect of having the counter weight directly opposite the float may also facilitate turning of the cleaner. When the downward rotational force of the counter weight and the corresponding upward rotational force of the float are in opposed relation, it is believed that this may increase the torque applied to the body so as to turn the cleaner back down the wall.

Suitably, the guideway and hence the attachment point of the float to the body is at or near the centre of mass of the body. This means that the rotational force applied by the float acts on or near the centre of mass of the body which is believed to further facilitate turning of the body. By near the centre of mass means within a range of points in which the weight distribution force of the point is between about 30% to 70%, preferably about 40% to 60%.

The guideway defines an arc that is co-axial with the longitudinal axis of the body. The arc is suitably symmetrical about a point of the guideway that is uppermost when the cleaner is travelling across a pool floor. The angle defined by the arc is typically between 140° to 220°, more suitably between 160° and 200°, and most suitably 180° C.

The guideway may be may be formed integrally with the body, in which case the body is suitably circular.

More suitably the guideway is formed separately from the body and may be connected to the body.

Suitably the guideway is releasably connected to the body. Suitable methods of releasably connecting an arcuate body from a curved body are known and include snap or friction fit connections. The guideway may have projections that fit or clip into mounting points such as slots or recesses located on the body.

Suitably the body has at least two axially aligned mounting points for the guideway. This allows for the position of the guideway to be axially adjustable. This allows the operation of the cleaner to be adjusted or tuned to operate in different size and/or shaped pools and the like.

When the guideway is formed separately from the body, it is not necessary for the body to be of circular cross section.

DETAILED DESCRIPTION OF THE DRAWINGS

Figure 1:
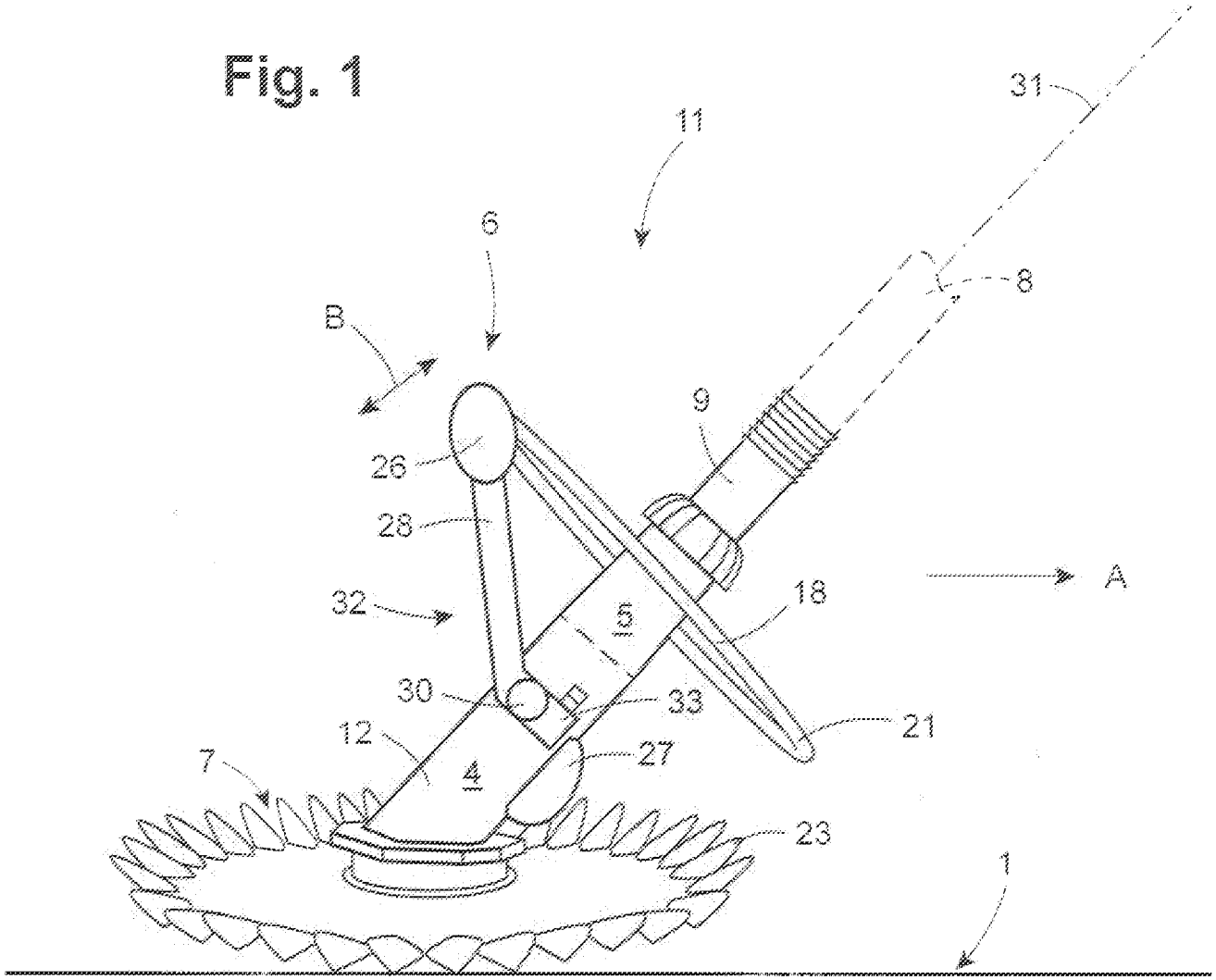
FIG. 1 is a schematic view of a preferred pool cleaner of the present invention traversing a pool floor.

FIG. 1 illustrates a preferred pool cleaner 11 shown traversing across a pool floor 1. The cleaner has a body 12 with an upper outlet end 9 coupled to a suction hose 8. The other end of the suction hose 8 is connected to the skimmer intake of the pool's filter system (not shown).

The lower end 7 of the body 12 is a lower suction end with a fluid inlet that is surrounded by a skirt 23. The structure and function of the skirt 23 is known in the art and need not be described further.

The body 12 travels in a direction towards the suction hose 8 in the direction shown by arrow A. Self propelled pool cleaners typically travel in a random directions across a pool floor in the direction of the suction hose 8.

When the cleaner 11 is traveling horizontally across the pool floor, the lower side 5 is the leading side and the upper side 4 is the trailing side. It may be seen therefore that the body 12 is forwardly inclined in the direction of travel A.

The body has a counter weight 27 integral with the lower side 5 of the body 12.

The cleaner 11 has a float assembly 6 consisting of a float 26 suspended from the upper side 4 of the body 12 and two rigid pivot arms 28 with their distal ends attached to the float and their proximal ends pivotally mounted to a float mounting mechanism 32.

The float is an elliptical cylinder with a length of about 9 cm and elliptical axis of 8 cm and 4 cm. The float is filled with a material having an S. G of about 1 so that even if the float becomes cracked, the cleaner will still work properly.

The pivot arms each have a length of 13 cm.

The float mounting mechanism 32 includes a pivot pin 30 that extends transversely from the body 12. The proximal ends of pivot arms 28 are mounted to the pivot pin for pivotal movement towards and away from the lower suction end 7 of the body in the direction shown by arrow B.

The float mounting mechanism also includes a C shaped circular guideway 33. The guideway 33 defines a circular arc of 180° that has an axis that is co-axial with the longitudinal axis 31 of the body 12.

The guideway 33 is mounted to the body at a position at or about the centre of mass of the body 12.

The guideway 33 is vertically above a part of the counterweight 27. The advantages of such an arrangement will be discussed further below.

The operation of the guideway 33 will be described in further detail below with respect to FIGS. 7 and 8.

The cleaner 11 includes a bumper wheel 18 attached at right angles to the upper outlet end 9 of the body 12.

Figure 2:
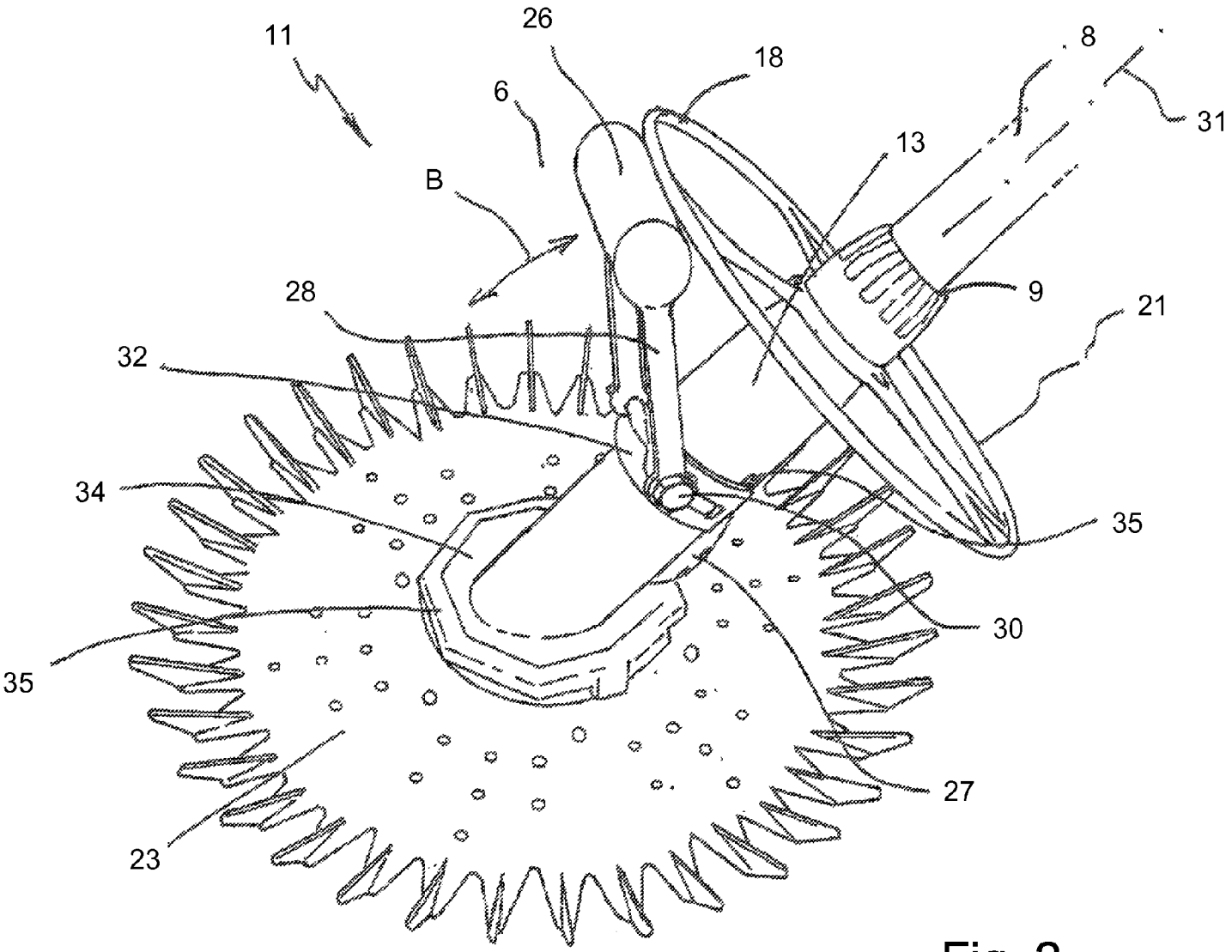
FIG. 2 is an isometric view of the pool cleaner shown in FIG. 1.

FIG. 2 is a top isometric view of the cleaner 11 as shown in FIG. 1. This view shows the guideway 33 extending around the upper side 4 of the body 12. The guideway 33 is removeably mounted to the body 12.

The body 12 has a three pairs of laterally disposed slots 35 that receive tangs 66, 67 (shown in FIG. 5) on the guideway 33. Provision of the additional pairs of slots 35 allows the position of the guideway 33 with respect to the body 12 to be axially adjustable. In this way a user can adjust the position of the pivot axes with respect to the counter weight 27. This adjustment can alter the time in which the cleaner spends on the wall, which may vary with height and angle of the wall, the amount of debris on the wall and the like.

Figure 3:
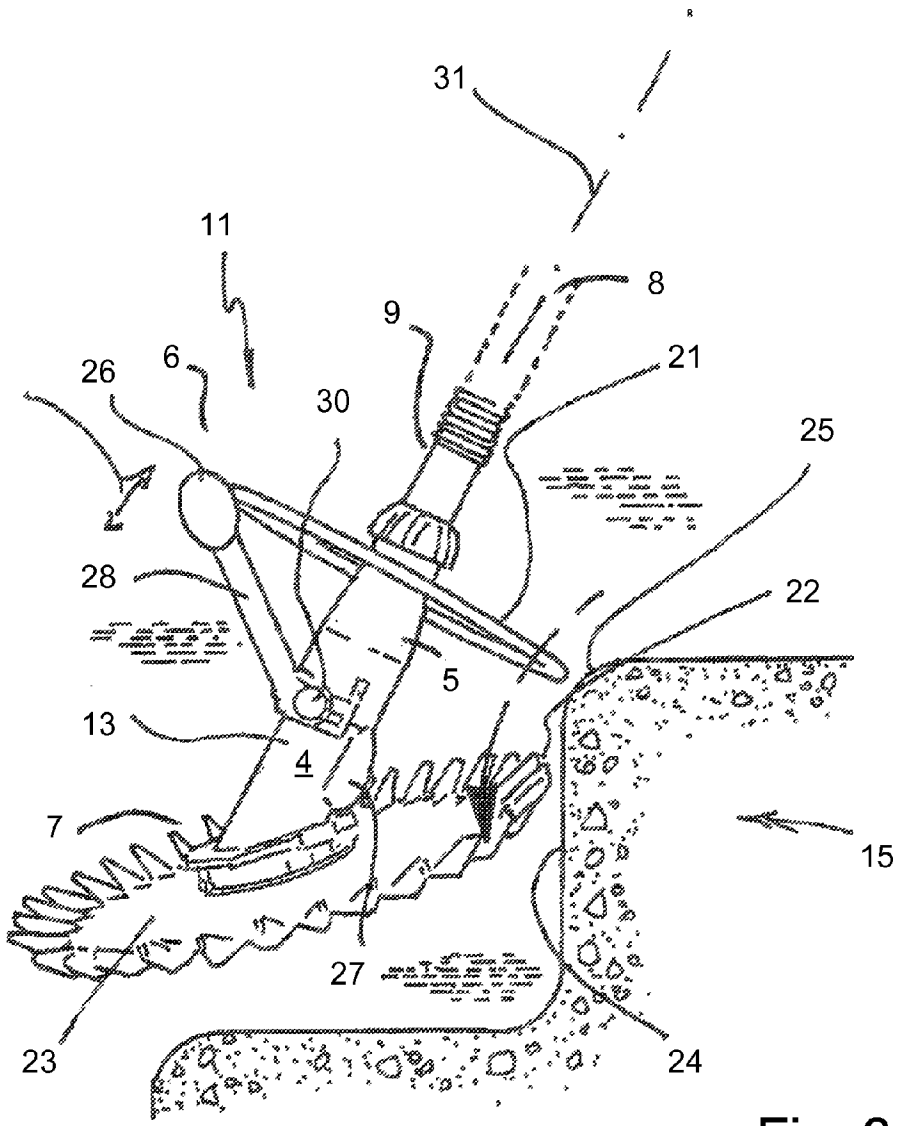
FIG. 3 is a schematic view of a further preferred pool cleaner of the present invention in use.

FIG. 3 shows the pool cleaner 11 as shown in FIGS. 1 and 2 traversing a series of pool steps 15. An advantage of the deflector wheel 18 and its location with respect to the body 12 will now be described.

The spacing between the lower extremity 21 of the bumper wheel 18 and the closest peripheral edge 22 of the skirt is shorter than the height 24 of step 15, in this case about 180 mm. Thus it is not possible for the step corner 25 to pass between the bumper wheel 18 and the skirt periphery 22 at their nearest points so as to prevent the cleaner 11 from hanging up on the step 15.

Figure 4:
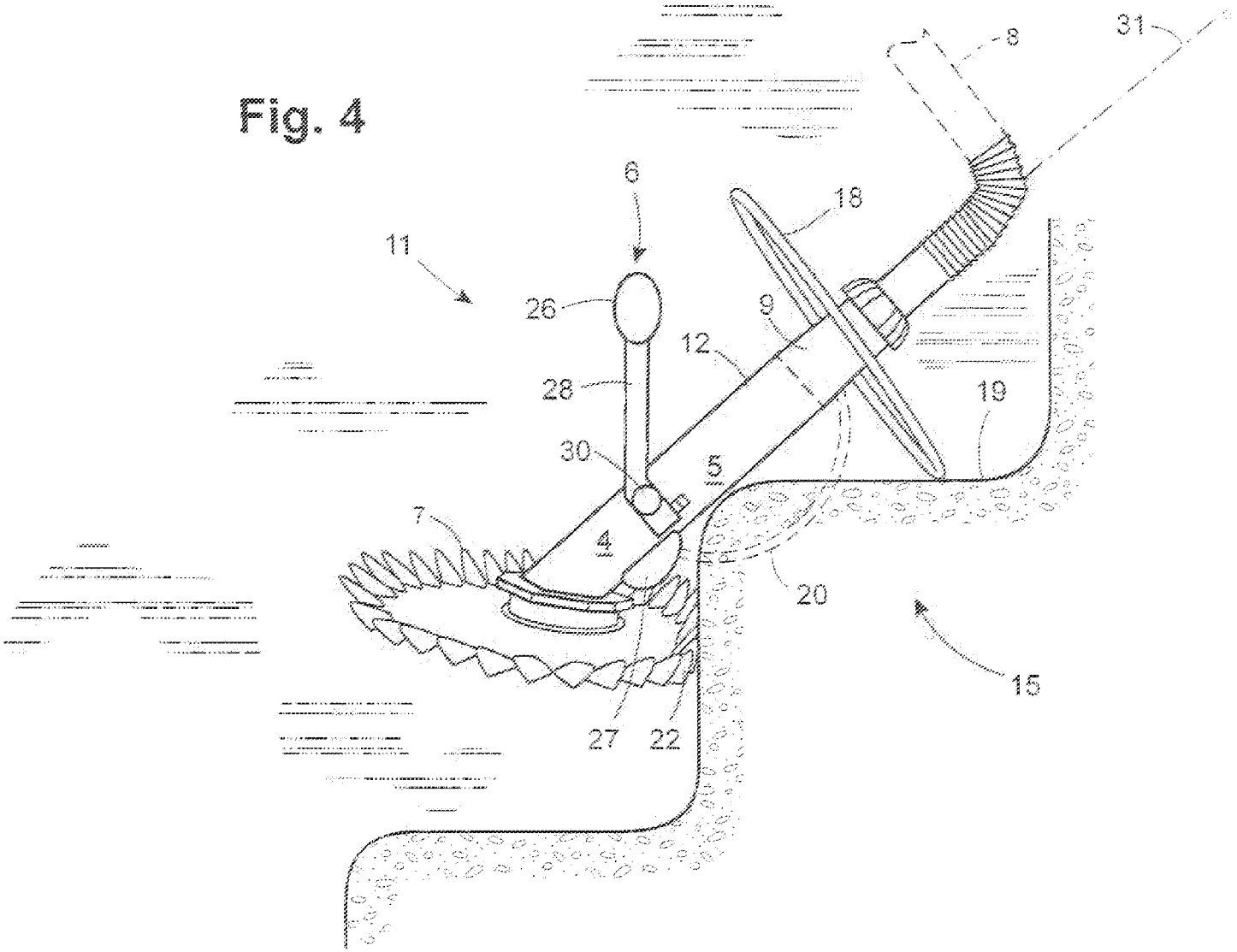
FIG. 4 is a schematic view of the pool cleaner shown in FIG. 1 in use.

FIG. 4 shows a further preferred pool cleaner 11 of the present invention that is also traversing steps. The same reference numerals will be used to represent the same features shown in the cleaner 11 as shown in FIGS. 1 to 3.

In the cleaner of FIG. 4, it may be seen that the distance between the lower extremity of the bumper wheel 18 and the closest peripheral edge of the skirt is such that it allows the corner 25 of the step to contact the lower side 5 of the cleaner 12 and the bumper wheel 18 is caught on the horizontal section 19 of the step 15. In order to overcome this problem, a bumper strap 20 (shown in phantom) can be fitted. Such straps are known.

A comparison of FIGS. 3 and 4 will show that with the cleaner 11 of FIG. 4, the float arms 28 are oriented vertically. However, with the cleaner as shown in FIG. 3, the presence of the deflector wheel 18 physically prevents the arms 28 from becoming vertical in response to the force generated by the buoyancy of the float. Such an arrangement offers a still further advantage when the cleaner is turning down a pool wall as will be discussed further below.

Figure 5:
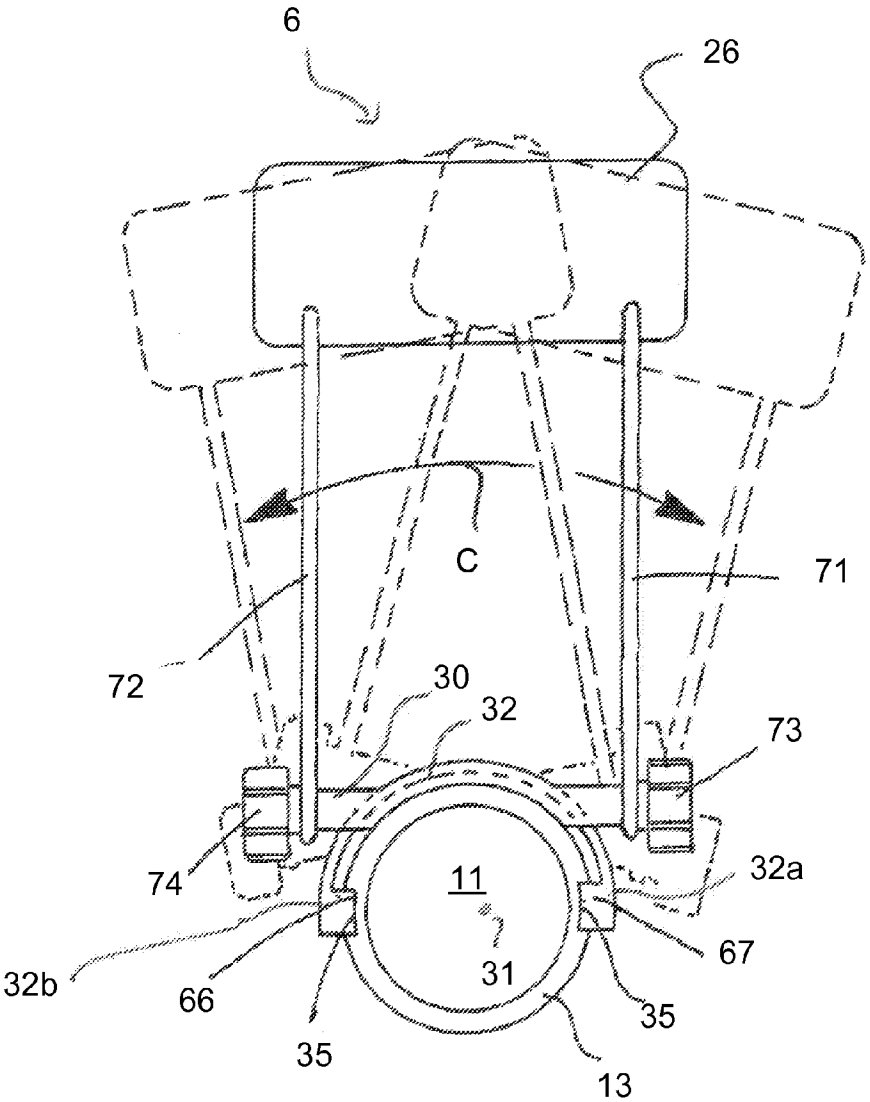
FIG. 5 shows a front detail of the float assembly of the pool cleaner shown in FIG. 1.

FIG. 5 shows a front detail of the float assembly 6 of the cleaner as shown in FIGS. 1 to 3. The guideway 32 may be seen to be C shaped defining a 180° arc that is coaxial with the longitudinal axis 31 of the body 12.

The guideway 33 is removeably mounted to the body by means of tangs 66, 67 that are received within diametrically opposed slots 35 in the body. The guideway 33 is made from a resilient plastics material such that the tangs 66, 67 can snap fit into position within the slots 35. The resilience allows the tangs 66, 67 to be manually disengaged by a user.

Figure 6:
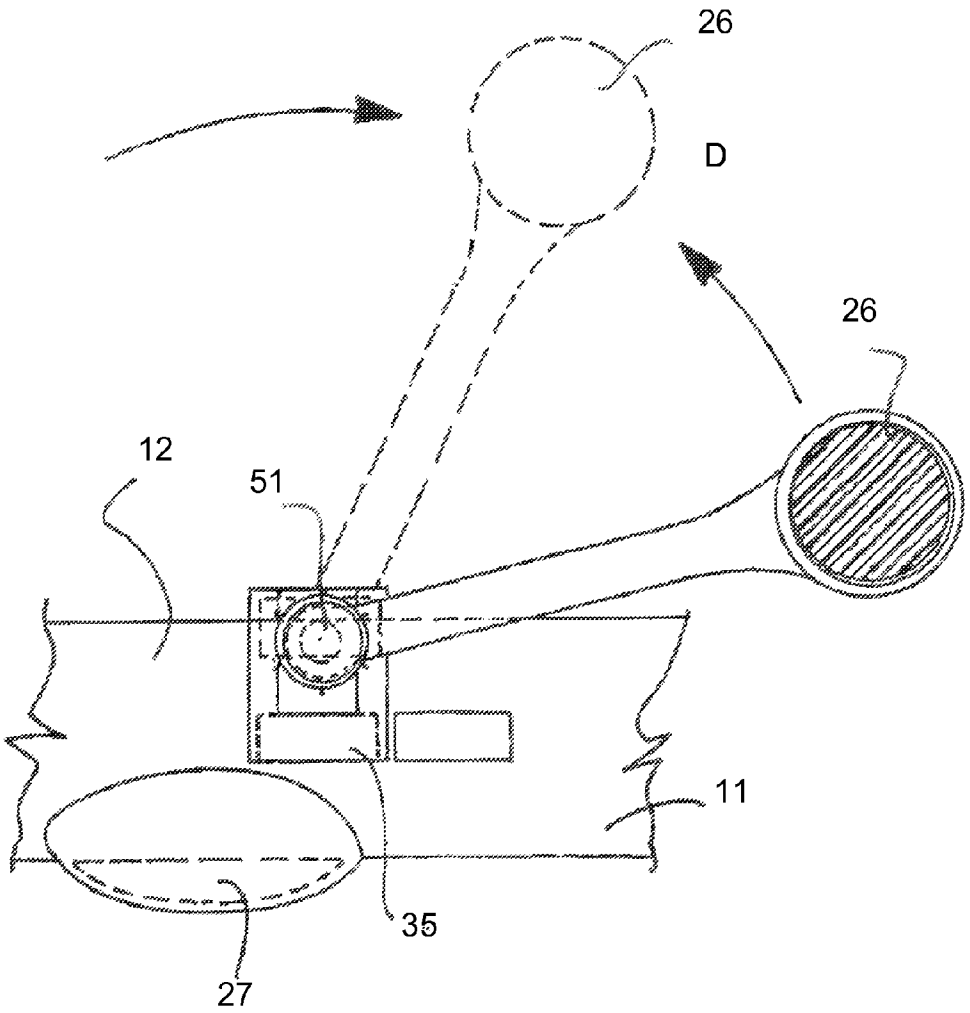
FIG. 6 is a detailed schematic view of the float assembly of the pool cleaner shown in FIG. 1.

As mentioned above, the body 11 has three pair of opposed slots 35 and two of which can be seen in FIG. 6. This allows the position of the guideway 33 on the body 11 to be axially adjustable.

Turning back to FIG. 5, it can be seen that pivot pin 30 is mounted on the guideway 33 for side to side movement about axis 31. The pivot arms 28 have circular openings in their ends through which pin 30 passes. The guide has internal blind bores 82, 83 with a rib 84 (shown in FIGS. 7 and 8) at each end for receiving stubs 73, 74 that serve to retain arms 28 in place.

FIG. 5 shows that side to side movement of the pivot pin 30 within the guideway causes a side to side motion of the float in the direction of arrow C. The side to side movement of pivot pin 30 is constrained within the limits defined by the ends of the guideway 33.

FIG. 6 shows the backwards and forwards pivotal movement of the float 26 about the pivot point 51 defined by pivot pin 30 in the directions of arrows D.

Figure 8:
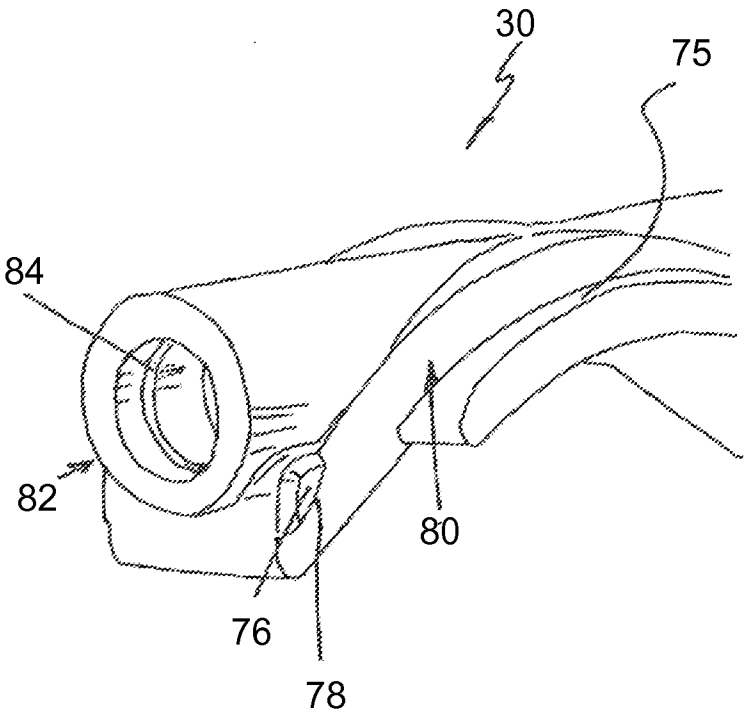
FIG. 8 illustrates the guideway shown in FIG. 7 in greater detail.
Figure 7:
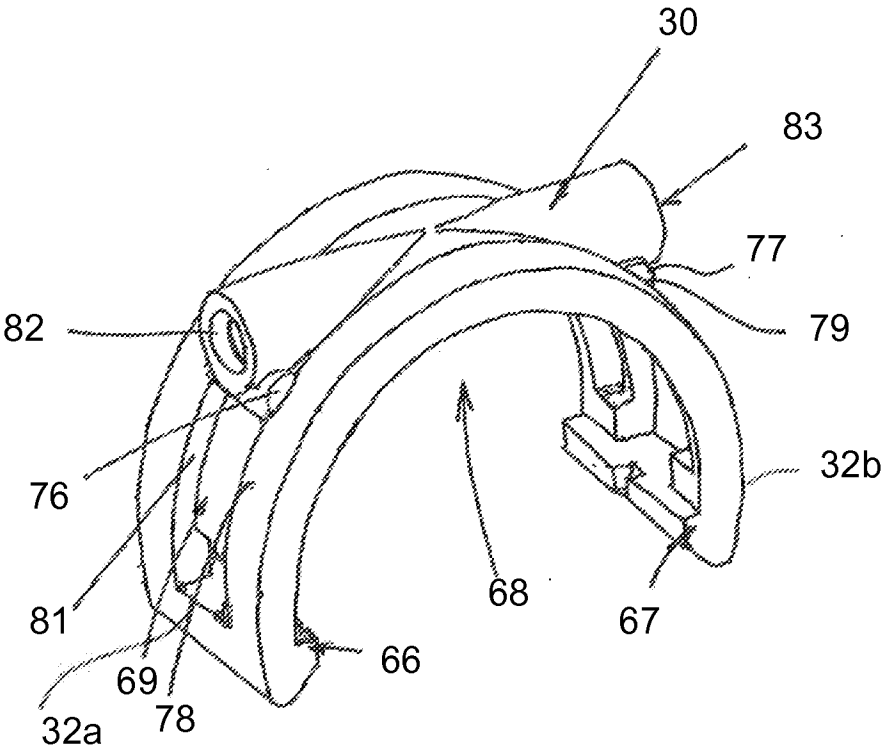
FIG. 7 illustrates the guideway of the pool cleaner as shown in FIG. 1.

FIGS. 7 and 8 show details of the guideway 33. The pivot pin 30 has a circular shoulder 75 and projections 76 and 77 at each end thereof. The guideway 32 has a pair of opposed rails 81, 78. The pivot pin 30 has opposed arcuate shoulders 75 extending from a surface 80 and projections 76, 77 at each end of the shoulder. The rail 78 of the guideway 32 is thereby retained between the shoulder 75 and the inner surfaces of the projections 76, 77 with the rail against the surface 80.

A corresponding structure is on the opposite side of the guideway 33 and this retains the rail 81 so that the pivot pin 30 slides around a circular path defined by rails 78, 81.

The ends of the guideway 33 serve as stops for limiting the side to side movement of the float assembly 6.

In normal use, pool cleaners of the pulsating flow type traverse the bottom of a pool in a random manner following the suction hose around the pool. When the skirt reaches a non-horizontal surface such as a pool wall, the cleaner begins to climb the wall. In some cases, the cleaner will continue to climb the wall until for some reason suction is lost which causes the cleaner to fall from the wall. This may occur for example if the skirt passes over a projection on the wall such as a light.

It is desirable that upon falling, the cleaner is able to right itself so that it can recommence cleaning. Some prior art cleaners as discussed previously, use a float and a counter weight to assist in righting the cleaner. The counter weight pulls that side of the body to which the weight is mounted towards the bottom of the pool, whereas a float located on the opposite side of the body lifts that side up.

However, if the cleaner falls from a wall when it is relatively close to the floor, there may be insufficient time and/or space for the cleaner to right itself. On the other hand with the cleaner of the invention, when the body is in a sideways or partially sideways orientation in the water, the float assembly can rotate sideways. This sideways moment is limited in either direction. When the sideways limit is reached, the float applies an upward moment to the body thereby urging the body to rotate in the water. The counter weight, being on the other side of the body to the float pulls the body around in the same rotational direction as the float is applying an upwards moment. In this manner, a pool cleaner of the present invention may be able to right itself more quickly than other cleaners.

A person of skill in the art will appreciate that by constraining the motion to side to side and not allowing right to left movement, the torque applied to the body by the sideways movement of the float may be optimized.

Figure 9:
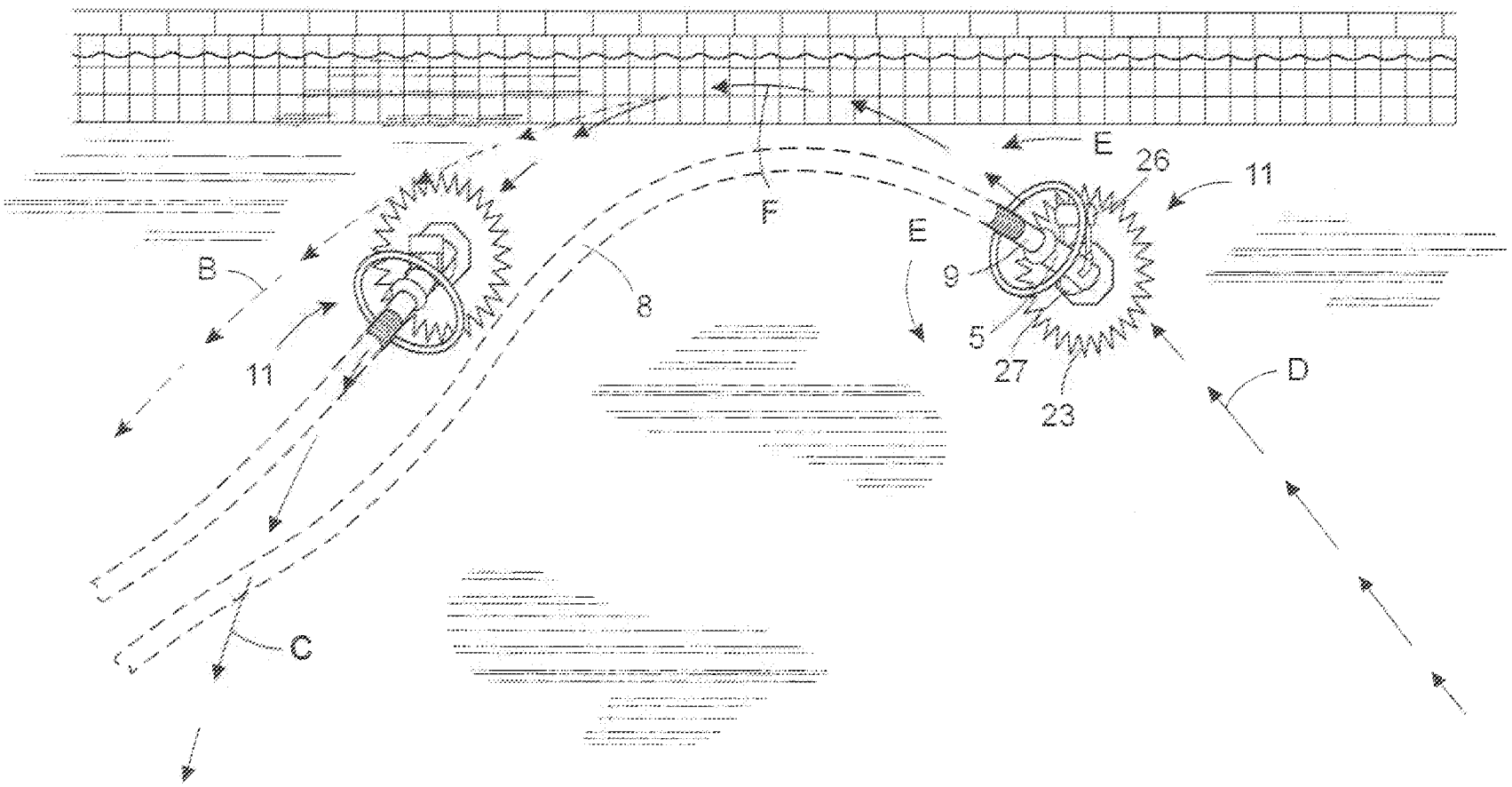
FIG. 9 is a schematic illustration of the pool cleaner shown in FIG. 1 traversing the wall of a swimming pool.

The side to side movement of the float assembly may also facilitate turning of a pool cleaner back towards a pool floor when the cleaner is traversing a pool wall. This is shown schematically in FIG. 9 in which a pool cleaner 11 is shown traversing a pool wall.

The trajectory back down the wall of a prior art pool cleaner having a counter weight and a float that cannot move from side to side is shown by broken arrows B, whereas the trajectory of a pool cleaner of the present invention having a dual side to side and backwards and forwards pivoting action in two degrees of rotational freedom is shown by the solid arrows C.

When a conventional cleaner or a cleaner of the present invention meets the junction between the pool floor and the wall, they both begin to climb the wall in the direction of the hose. The orientation of the cleaner is tilted slightly due to the weight of the hose (shown in phantom) such that both cleaners initially travel up the wall at an angle of about 30° to 50° as shown by solid arrows D.

As both cleaners travel up and across the wall, they are urged to turn around by the weight of the hose and the weight of the counter weight. However, the cleaner 11 turns down the wall sooner than prior art cleaners. The path taken by prior art cleaners is marked by arrows B and that taken by the cleaner 11 shown by arrows C.

As the cleaner 11 travels across the wall, the weight 27 which is at the front of the cleaner pulls the front of the cleaner downwards in the direction indicated by arrow E. At the same time, the float moves sideways in response to the change in orientation of the body. At a certain point, the limit of the sideways movement of pivot pin 30 within the guideway 33 is reached. When this occurs, the float 6 applies an upwards moment to the cleaner 11 in the same direction as the weight 27 is pulling the front of the cleaner around.

Whilst not wishing to be bound by theory, it is believed that the geometry of the relative positions of the float and weight and that the float is constrained to side to side movement, with right to left not being permitted, optimizes the torque that is applied to the body to turn the body sooner than prior art cleaners. In particular, the position of the counter weight and guideway being vertically opposite each other (when travelling across the floor), i.e. horizontally opposite when travelling along the wall enables the torque to be optimised for better turning rather than twisting which would occur where the float and the counter weight are not so orientated. See for example, the arrangement in U.S. Pat. No. 6,119,293 in which the float is attached at the very base of the upper side and well below the centre of gravity of the body.

As the cleaner 11 travels up the wall and the orientation of the body 11 relative to the horizontal changes, the lower skirt end 5 approaches the level of the upper outlet end 9. This occurs when the cleaner 11 begins to move horizontally across the wall at or before the position shown as F. At a certain point, the float 26 pivots away from the hose end 9 towards the suction end 7 so as to change the centre of gravity causing the cleaner 12 to turn back down the pool. However, with the cleaner of the present invention, because the float 26 has already moved sideways, its position is ahead of the body 12 as shown in the schematic illustration of the cleaner 11 travelling up the wall in FIG. 8. This means that the float 26 can pivot back towards the skirt sooner than it would if it was fixed in a position directly behind the body in the direction of travel.

A further advantage of the cleaner 11 is having the bumper wheel 18 located closer to the skirt 23 that pivotal movement of the float 26 towards the upper outlet end 9 is limited by the bumper wheel 18. When the cleaner 11 is travelling up the wall, the float 26 rides against the bumper wheel 18 and is prevented from lying across the body 12. Then the cleaner 11 begins to move horizontally across the wall, the float 26 is already substantially in position for turning the pool cleaner back down the wall.

It will be appreciated that various changes and modifications may be made to the cleaner as described and claimed herein without parting form the spirit and scope thereof.

What is claimed is:

1. A self-propelled pool cleaner having;

an inclined body having a longitudinal axis, a lower suction end, an upper outlet end connectable to a suction hose, an upper side and a lower side, the body being forwardly inclined relative to the direction of travel across a submerged surface;

a counter weight mounted to the lower side of the body;

a float assembly including a float suspended from the upper side of the body and at least one rigid pivot arm having a distal end attached to the float;

a float mounting mechanism including a pivot pin extending transversely from the body to which the proximal end of the at least one rigid pivot arm is pivotally mounted to allow pivotal movement of the float towards and away from the lower suction end of the body;

a guideway defining a circular arc having an axis that is co-axial with the longitudinal axis of the body and that is located on the upper side of the body at a position that is vertically opposite to at least a part of the counterweight;

the pivot pin of the float mounting mechanism is mounted to the guideway for movement within the guideway to allow side to side movement of the attached float that is constrained to movement through the arc co-axial with the longitudinal axis of the body;

wherein the pivotal movement of the float towards and away from the lower end of the body and the side to side pivotal movement are independent and are the only degrees of freedom in which the float is permitted to move.

2. The cleaner of claim 1, wherein the guideway is located on the body at or near the centre of mass of the body.

3. The pool cleaner of claim 1, wherein the circular arc defined by the guideway has an angle of 180°.

4. The pool cleaner of claim 1, wherein the ends of the guideway serves as stops for constraining the side to side movement of the float.

5. The pool cleaner of claim 1, wherein the guideway is formed integrally with the body.

6. The pool cleaner of claim 1, wherein the guideway is C shaped.

7. The pool cleaner of claim 6, wherein the guideway is formed separately from the body.

8. The pool cleaner of claim 7, wherein the body has opposed latches into which ends of the C shaped guideway are clipped.

9. The pool cleaner of claim 8, wherein the body has at least two pairs of opposed latches for receiving ends of the C shaped guideway so that the position of the C shaped guideway on the body is axially adjustable.

10. The pool cleaner of claim 1, wherein the counter weight is integral with the body.

11. The pool cleaner of claim 1, wherein the float is a cylindrical float having its axis transverse to the longitudinal axis of the body.

12. The pool cleaner of claim 11, wherein a rigid pivot arm is connected to each end of the float.

13. The pool cleaner of claim 1, wherein the pivot pin has a length that is about as wide as the body adjacent the pivot pin.

14. The pool cleaner of claim 1, wherein the pool cleaner includes a deflector wheel mounted to the body towards the upper outlet end in a plane substantially at right angles to the body and an upper portion of the deflector wheel blocks pivotal movement of the float towards the upper outlet end of the body.

* * * * *